US005205379A

United States Patent [19]

Pfleger

[11] Patent Number: 5,205,379

[45] Date of Patent: Apr. 27, 1993

[54] VERTICAL CONVEYOR

[75] Inventor: Robert H. Pfleger, Milwaukee, Wis.

[73] Assignee: Pflow Industries Inc., Milwaukee, Wis.

[21] Appl. No.: 767,262

[22] Filed: Sep. 27, 1991

[51] Int. Cl.[5] ..... B66B 11/04

[52] U.S. Cl. ..... 187/26; 187/17; 187/20; 182/141

[58] Field of Search ..... 187/2, 6, 8.41, 9 R, 187/20, 26, 17; 182/141, 143, 148

[56] References Cited

U.S. PATENT DOCUMENTS

| | | | |
|---|---|---|---|
| 3,757,899 | 9/1973 | Smith, Jr. | 187/17 |
| 4,222,461 | 9/1980 | Gunti | 187/20 |
| 4,252,217 | 2/1981 | Benjamin | 187/26 X |
| 4,830,146 | 5/1989 | Nakamura et al. | 187/26 |
| 5,056,627 | 10/1991 | Pelto-Huikko | 187/20 |

OTHER PUBLICATIONS

"Vertical Material Handling", Pflow Industries, Inc., Milwaukee, Wis.

"Nothing Lifts Like A Langley", Mfg. Div. of M. D. Knowlton Co. Victor NY.

*Primary Examiner*—Joseph E. Valenza
*Assistant Examiner*—Tuan N. Nguyen
*Attorney, Agent, or Firm*—Andrus, Sceales, Starke & Sawall

[57] ABSTRACT

A vertical conveyor for lifting materials between different vertical levels. The conveyor comprises a pair of spaced upright supports or beams and a carriage to support a load or cargo is guided for vertical movement on the beams. A hydraulic cylinder unit is associated with each beam and the ram or piston rod of each cylinder unit carries a first sheave, while a second sheave is located at the upper end of each beam. A link chain formed of a plurality of interconnected loops is trained over each first and second sheave, and one end of each chain is dead-ended on the respective beam, while the opposite end of the chain is connected to the carriage. Retraction of the piston rod will move the carriage upwardly to a second vertical level. The axes of the first sheaves are located at 90° with respect to the axes of the second sheaves, so that the cylinder can be mounted tight against the beams to minimize the bending moment. A horizontal shaft connects the second sheaves and synchronizes movement of the two chains.

15 Claims, 2 Drawing Sheets

FIG. 1
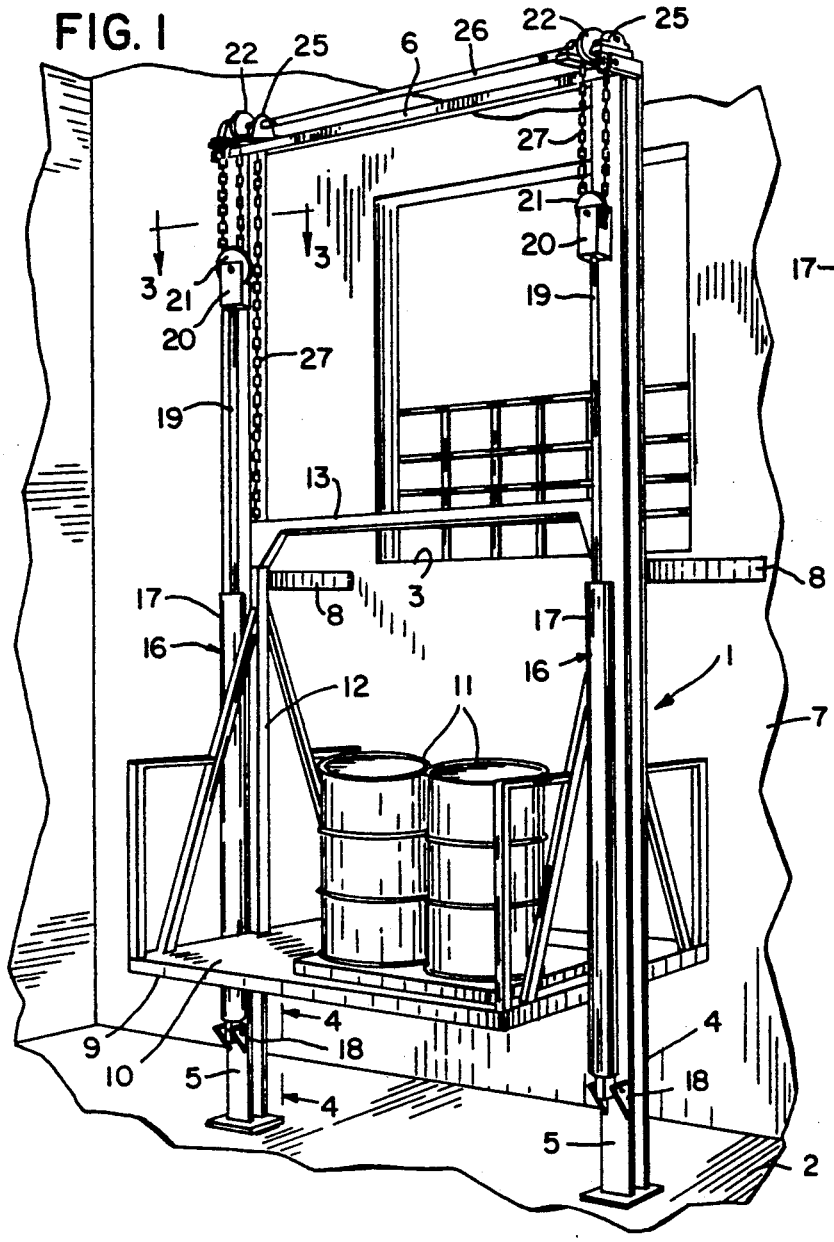
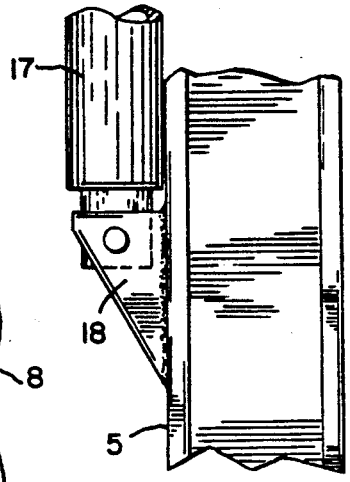
FIG. 4
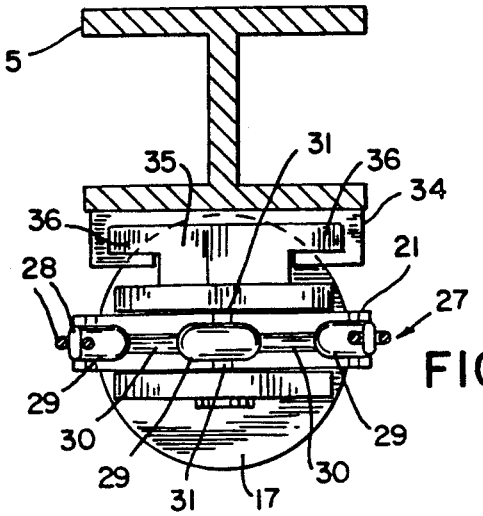
FIG. 3

VERTICAL CONVEYOR

BACKGROUND OF THE INVENTION

Vertical reciprocating conveyors are employed warehouses, factories, and the like to convey materials between different vertical levels. The typical vertical conveyor includes a supporting structure or frame and a carriage, which is adapted to support a cargo or load, is guided for vertical movement on the supporting structure. The carriage can be moved upwardly and downwardly on the structure by either a mechanical or hydraulic drive. In one common form of vertical conveyor, the carriage or platform is cantilevered from the supporting structure, and lifting and lowering is accomplished through a single cylinder attached through a pair of roller chains to the carriage. The chains are arranged, such that there is a 2:1 relationship between carriage movement and piston rod extension.

The cantilevered type of vertical conveyor has a serious drawback, in that it cannot accommodate heavier loads. As all of the weight of the load is cantilevered from the supporting structure, the forces on the carriage and the guide mechanism are extremely high resulting in possible distortion of the guide structure and the carriage, and unacceptable wear on the guide rollers, bearings, etc.

In a second form of vertical conveyor, the load carrying platform or carriage is straddled between two vertical supports or beams. This results in a balanced load, so that the stress on the supporting structure, guide rollers and bearings is minimal.

With the typical straddle design, lifting and lowering of the carriage is accomplished through the use of two hydraulic cylinders, each mounted on one of the vertical beams. The piston rod of each cylinder unit is connected through a sheave and wire cable arrangement to the carriage, in a manner such that the carriage is elevated by retraction of the piston rods. The "pull mode" of lifting the carriage is more stable than a "push mode", for in high rise applications using a "push mode", the ram or piston rod can be extended to a range of about ten feet, with the result that there is considerable load on the packing glands of the cylinders, as well as a high bending force that is imparted to the extended piston rod or ram.

With the straddle-type of vertical conveyor using a pair of hydraulic cylinder units, there is a problem in synchronizing the action of the two cylinder units. While there are hydraulic devices to accomplish synchronization, these devices require sophisticated valving and electronic programming and are not appropriate in terms of cost for a vertical conveyor.

The absence of cylinder synchronization is most pronounced when there is an eccentric or off-center load on a relatively large carriage. While both cylinders see the same hydraulic pressure, the uneven load makes the cylinders pull unevenly, and as a result, a racking force is introduced to the carriage. The racking force is resisted by guide rollers on the carriage running against a guide track on the upright vertical beams. However, the upright vertical beams, as used in a typical vertical conveyor, are not precisely machined components and are subject to dimensional tolerances of plus or minus 0.125 inch, and as a result cannot serve as precise guides. Further, the vertical beams are often unsupported for as much as twenty feet, and thus an eccentric load on the carriage imposes stresses on the beams and causes severe wear of the guide members that ride on the guide tracks on the beams.

Because of the sheaving arrangement, the cylinders of the typical vertical conveyor are spaced laterally of the vertical beams, and this lateral spacing imparts a bending force to the beams. Because of this, it has been the practice to reinforce the vertical beams using diagonal braces, which increases the manufacturing and installation cost of the conveyor.

SUMMARY OF THE INVENTION

The invention is directed to an improved vertical reciprocating conveyor for lifting materials between different vertical levels and has particular application for use in warehouses, factories, and the like.

The conveyor comprises a pair of spaced vertical supports or beams and a carriage is guided for vertical movement on the supports.

To raise and lower the carriage, a hydraulic cylinder unit is associated with each vertical beam. The cylinder of each unit is secured to the lower portion of the respective vertical beam, while the piston rod or ram that is slidable in the cylinder carries a first sheave. In addition, a second sheave is located at the upper end of each beam and a horizontal shaft interconnects the two second sheaves. Trained over the respective first and second sheaves is a link chain composed of a plurality of interlocked loops, and one end of each chain is deadended on the respective beam, while the opposite end of each chain is connected to the carriage. With this construction, downward movement or retraction of the rams will elevate the carriage.

As a feature of the invention, the axis of each first sheave is located at 90° with respect to the axes of the second sheaves and this enables the cylinders to be mounted in close relation to the respective vertical beams, thereby reducing the bending force imparted to the beam as the carriage is raised and lowered. The use of the link chain permits this relationship between the first and second sheaves for the interconnected links permit directional changes of the chain.

By tying the second sheaves together through use of a connecting shaft, the operation of the two cylinders is synchronized, assuring that the carriage will always be in a level condition despite eccentric loading.

As a further advantage, the link chain has a service life substantially greater than that of wire rope or cable, as used in a conventional hydraulically operated vertical conveyor. Wire rope must bend as it passes over relatively small diameter sheaves causing the wire to eventually fatigue and fracture. The fatigue of the wire is a function of the diameter of the sheaves, and with a vertical conveyor there is a practical limit as to the diameter of the sheaves, with the result that cable fatigue and failure is a common problem.

A further advantage of the link chain is that it is subjected to less stretch under load than a wire rope or cable, thus ensuring a more stable carriage, particularly when it is loaded at an upper level. With a cable operating system, the positioning of a heavy load on the carriage may result in the lowering of the carriage an inch or more due to stretch in the cables, and as a vertical conveyor does not utilize automatic leveling devices, this drop of the carriage can cause an obstruction to material handling equipment.

As a further advantage, the link chain has the ability to provide an indication of wear or overload. As a link chain begins to wear, it does not seat efficiently into the pocketed sheaves, and as a result the chain can produce a loud chattering which announces that wear has occurred, which is well before failure could occur. Similarly, if the link chain is subjected to overload it can stretch and may not properly seat in the pocketed sheaves, also resulting in chattering.

Other objects and advantages will appear in the course of the following description.

DESCRIPTION OF THE DRAWINGS

The drawings illustrate the best mode presently contemplated of carrying out the invention.

In the drawings:

FIG. 1 is a perspective view of the vertical conveyor of the invention;

FIG. 3 is a transverse section taken along line 3—3 of FIG. 1; and

FIG. 4 is a fragmentary side elevation taken along line 4—4 of FIG. 4.

DESCRIPTION OF THE ILLUSTRATED EMBODIMENT

Figure 2:
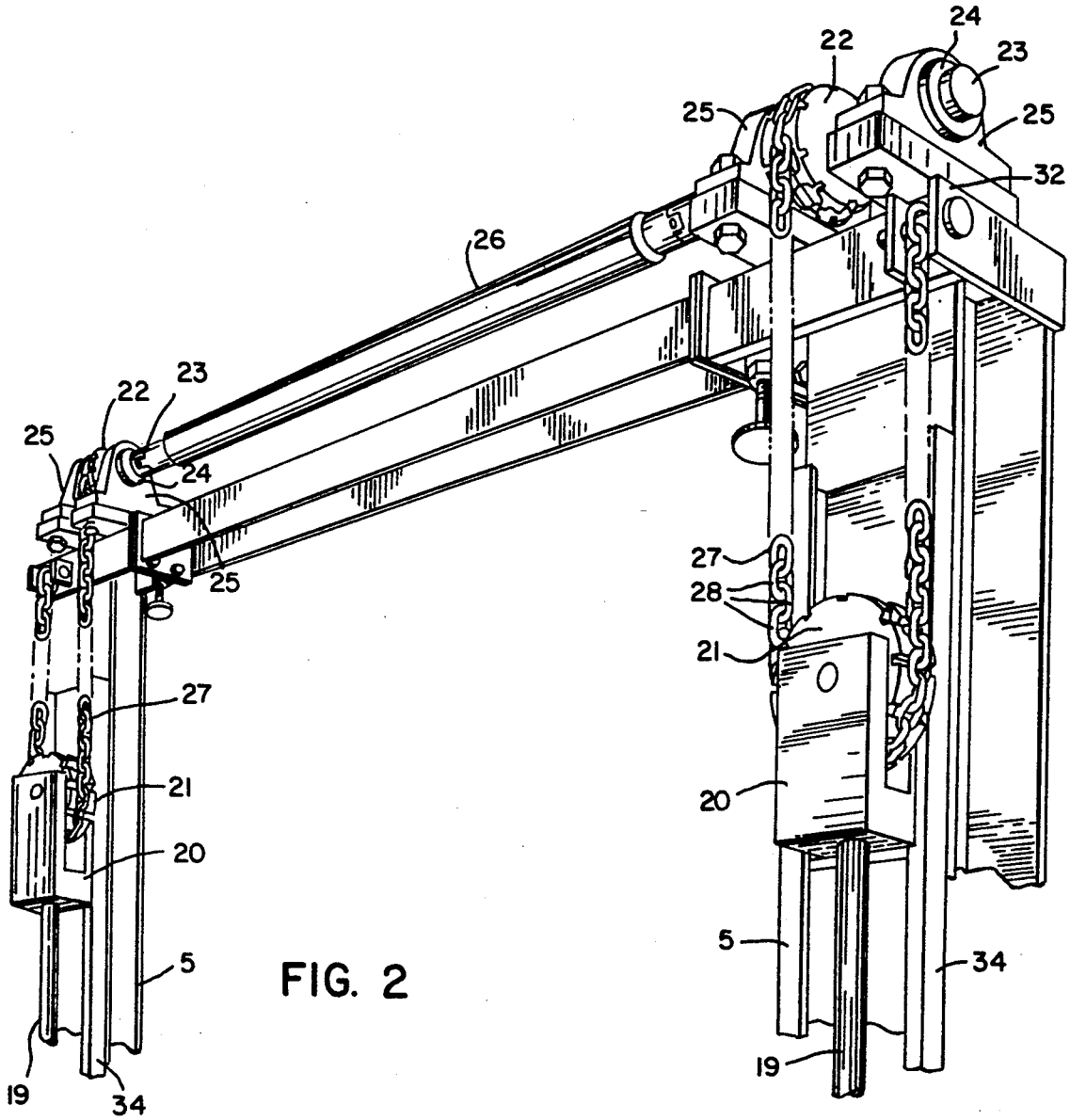
FIG. 2 is an enlarged perspective view showing the link chain and sheave arrangement.

FIG. 1 shows a vertical reciprocating conveyor 1 which is adapted to transport materials between different vertical levels, such as for example, between a lower floor or level 2 and an upper floor or level 3.

Conveyor 1 includes a frame or supporting structure 4 composed of a pair of spaced, vertical I-beams 5. The lower ends of beams 5 are secured to the floor 2, while the upper ends of the beams are connected together by a cross member or beam 6. As shown in FIG. 1, the central portion of each beam can be supported from the vertical wall 7 by braces 8.

Mounted for vertical movement on beams 5 is a carriage 9. Carriage 9 includes a generally flat platform 10 adapted to support a load or cargo 11, and a pair of vertical supports 12 extend upwardly from opposite sides of platform 10 and the upper end of vertical supports 12 are connected by a horizontal brace 13. In addition, diagonal braces 14 can connect the upper end of each vertical support with the platform 10. In practice, an open mesh enclosure extends upwardly from the periphery of platform 10 to contain the load or cargo 11, and a movable gate encloses an opening or doorway in the enclosure, through which the cargo is loaded onto the platform 10. For purposes of clarity, the enclosure and gate are not illustrated in the patent drawings.

Carriage 9 is raised and lowered relative to frame 4 by a pair of hydraulic cylinder units 16, each of which is associated with one of the vertical beams 5. Each hydraulic cylinder unit 16 includes an elongated cylinder 17, the lower end of which is pivotally connected to lugs 18 which project laterally from the lower ends of the respective beams 5. A ram or piston rod 19 is mounted for sliding movement in each cylinder 17 and the upper end of each ram is connected to a clevis 20, which is best illustrated in FIG. 2.

Journaled for rotation each clevis 20 is a pocket-type sheave 21. In addition, a second pocket-type sheave 22 is associated with each beam 5 and is located above the cross beam 6. Sheaves 22 are carried by stub shafts 23, which are journaled in bearings 24 mounted in bearing blocks 25 that are supported on beam 6. The ends of the stub shafts 23 are connected by an elongated shaft 26, which is coupled to the respective ends of the stub shafts 23. With this construction, the rotation of the sheaves 22 is synchronized.

A link chain 27 is trained over the corresponding sheaves 21 and 22. Chain 27 is composed of a multiplicity of interlocked loops or links 28 with each link offset 90° from adjacent links.

The outer periphery of sheaves 21 and 22 are formed with elongated pockets 29, which receive the links 28 of chain 27. In addition, circumferential grooves 30 connect the adjacent ends of pockets 29 and lateral grooves 31 extend laterally from each pocket 29 to the sides of the sheave. Alternate links 28 are received flatwise in pockets 29, while adjacent links are received edgewise in grooves 30. The grooves 31 are adapted to receive any projections on links 28 that may have resulted during the welding of the ends of the links together.

As best illustrated in FIG. 2, one end of each chain 27 is dead-ended on bracket 32 attached to the respective vertical beam 5, while the opposite end of each chain 27 is connected to the horizontal member 13 of carriage 9.

With this construction, retraction, or downward movement of the rams 19, will move the carriage upwardly relative to frame 4. To lower the carriage, the flow of pressurized fluid to the cylinders 17 is terminated and the carriage will then descend by gravity with suitable valving in the hydraulic system providing a gradual descent in a conventional manner.

To guide the carriage 9 for movement on beams 5, a guide track 34, as shown in FIG. 4, is secured to each beam 5. Mounted for sliding movement in each guide track 34 is a guide block 35, preferably formed of a plastic material, such as polyethylene. Guide block 35 has a pair of opposed flanges or lips 36 that ride in the opposed recesses in the track 34.

As best shown in FIG. 2, the axes of sheaves 21 are located normal or at 90° to the axes of sheaves 22. This enables the sheave 21 to be located generally flatwise against the side of the beam 5, and permits the cylinder 17 to be located in close relation to the side of the beam, as shown in FIG. 4. By locating the cylinder 17 adjacent the respective beam, the bending moment imparted to the beam through operation of the cylinder unit is reduced, and thus bracing of the beams 5 can be minimized.

The use of the link chain enables the sheaves 21 and 22 to be located at 90° with respect to each other and other flexible drive members, such as cables or roller chains cannot accomplish this change of direction. Furthermore the link chains has a substantially increased service life as compared with cables or wire ropes and has the built in function of providing noise or chatter when worn, which occurs well before failure, thus providing a safety function.

As sheaves 22 are connected together by shaft 26, the operation of the two cylinder units 16 is synchronized, thereby ensuring that the carriage 9 will always be in a level condition despite eccentric loading and will not tend to rack or skew as it is raised and lowered. By synchronizing the movement, the stress imparted to the guide mechanism is reduced and possible distortion of the guide structure is eliminated.

Various modes of carrying out the invention are contemplated as being within the scope of the following claims particularly pointing out and distinctly claiming the subject matter which is regarded as the invention.

I claim:

1. A vertical conveyor, comprising a frame including a pair of spaced vertical supports, a carriage mounted for vertical movement on said supports, reciprocating drive means having one end connected to the frame and having a second end, a first sheave mounted on said second end of said drive means, a second sheave mounted on said frame, and a link chain comprised of a plurality of interconnects loops and trained over said first and second sheaves, said first and second sheaves each including a peripheral surface containing circumferentially spaced pockets to receive said loops, said chain having one end fixed with relation to the frame and the opposite end connected to said carriage, the axis of said first sheave disposed at about 90° to the axis of the second sheave, movement of said drive means in one direction acting through said link chain to raise said carriage.

2. The conveyor of claim 1, wherein said reciprocating drive means comprises a hydraulic cylinder unit.

3. The conveyor of claim 1, wherein said cylinder unit comprises a cylinder and a ram slidable with respect to said cylinder, said first sheave being connected to said ram.

4. The conveyor of claim 1, and including guide means for guiding said carriage for movement on said vertical supports.

5. The conveyor of claim 1, wherein said reciprocating drive means is mounted directly to one of said vertical supports.

6. A vertical conveyor, comprising a frame including a pair of spaced vertical supports, a carriage mounted for vertical movement on said supports, a pair of hydraulic cylinder units each associated with one of said vertical supports, each cylinder unit including a cylinder member and a piston member, one of said members being connected to the frame, a first sheave connected to the other of said members, a second sheave associated with each vertical support, a shaft interconnecting said second sheaves, a chain trained over the respective first and second sheaves and having one end connected to the frame and the other end connected to said carriage, relative movement between said cylinder member and said piston member acting to move said carriage on said vertical supports and said shaft acting to synchronize the movement of said cylinder units.

7. The conveyor of claim 6, wherein the axes of said first sheaves are disposed at about 90° with respect to the axes of said second sheaves.

8. The conveyor of claim 7, wherein each cylinder member is connected to the frame and is disposed immediately adjacent the respective vertical support.

9. The conveyor of claim 6, wherein said frame also includes a cross member connecting the upper ends of said vertical supports, said shaft being disposed parallel to said cross member.

10. The conveyor of claim 9, Wherein the axes of the second sheaves are axially aligned with the shaft and the axes of the first sheaves are disposed normal to the axes of the second sheaves.

11. The conveyor of claim 10, wherein one end of said chain is secured to the upper end of the corresponding vertical support at a connection, said chain passing downwardly from said connection over said first sheave and then upwardly over said second sheave and then downwardly for connection to said carriage.

12. The conveyor of claim 11, wherein each sheave is provided with a peripheral surface having a plurality of circumferentially spaced elongated pockets to receive the links of said chain, said peripheral surface also including a plurality of grooves, each groove connecting the ends of adjacent pockets.

13. A vertical conveyor, comprising a frame including a pair of spaced vertical supports, a carriage mounted for vertical movement on said supports, reciprocating drive means having one end connected to the frame and having a second end, a first sheave mounted on said second end of said drive means, a second sheave mounted on said frame, a chain trained over said first and said sheaves, said chain having one end fixed with relation to the frame and the opposite end connected to said carriage, movement of said drive means in one direction acting through said chain to raise said carriage, guide means for guiding said carriage for movement on said vertical supports, said guide means comprising a first guide member disposed on each first sheave and a second guide member on the respective vertical support.

14. The conveyor of claim 13, wherein said second guide member comprises an elongated guide track and said first guide member is movable on said guide track.

15. The conveyor of claim 14, wherein said first guide member comprises a block of plastic material.

* * * * *

UNITED STATES PATENT AND TRADEMARK OFFICE

CERTIFICATE OF CORRECTION

PATENT NO. : 5,205,379

DATED : April 27, 1993

INVENTOR(S) : ROBERT H. PFLEGER

It is certified that error appears in the above-identified patent and that said Letters Patent is hereby corrected as shown below:

Col. 5, Line 6, CLAIM 1,
Cancel "interconnects" and substitute therefor --interconnected- Col. 6, Line 34, CLAIM 13
Cancel "said", first occurrence, and substitute therefor --second--

Signed and Sealed this

Nineteenth Day of July, 1994

*Attest:*

Bruce Lehman

BRUCE LEHMAN

*Attesting Officer*

*Commissioner of Patents and Trademarks*